US006828073B2

(12) United States Patent
Matsumura et al.

(10) Patent No.: US 6,828,073 B2
(45) Date of Patent: Dec. 7, 2004

(54) TONER FOR DEVELOPING ELECTROSTATIC IMAGE, DEVELOPER FOR ELECTROSTATIC IMAGE, AND PROCESS FOR FORMING IMAGE

(75) Inventors: Yasuo Matsumura, Minamiashigara (JP); Hidekazu Yaguchi, Minamiashigara (JP); Satoshi Yoshida, Minamiashigara (JP); Takahisa Fujii, Minamiashigara (JP); Tomohito Nakajima, Minamiashigara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 110 days.

(21) Appl. No.: 10/219,544

(22) Filed: Aug. 16, 2002

(65) Prior Publication Data

US 2003/0148202 A1 Aug. 7, 2003

(30) Foreign Application Priority Data

Jan. 9, 2002 (JP) ..... 2002-002289

(51) Int. Cl.[7] ..... G03G 9/08

(52) U.S. Cl. ..... 430/108.1; 430/110.3; 430/111.4; 430/126

(58) Field of Search ..... 430/108.1, 110.3, 430/111.4, 126, 137.14

(56) References Cited

U.S. PATENT DOCUMENTS

| | | | | |
|---|---|---|---|---|
| 3,804,619 A | | 4/1974 | Mammino et al. | |
| 4,264,697 A | | 4/1981 | Perez et al. | |
| 5,346,797 A | | 9/1994 | Kmiecik-Lawrynowicz et al. | |
| 5,547,801 A | * | 8/1996 | Suzuki et al. | 430/109.3 |
| 6,153,346 A | | 11/2000 | Maehata et al. | |
| 6,391,510 B1 | * | 5/2002 | Ishiyama et al. | 430/111.4 |
| 6,440,627 B2 | * | 8/2002 | Shoji et al. | 430/108.1 |

FOREIGN PATENT DOCUMENTS

| | | |
|---|---|---|
| JP | 49-91231 | 8/1974 |
| JP | A 56-11461 | 2/1981 |
| JP | A 56-40868 | 4/1981 |
| JP | A 62-39879 | 2/1987 |
| JP | A 63-282752 | 11/1988 |
| JP | A 6-250439 | 9/1994 |
| JP | B2 3107062 | 9/2000 |

* cited by examiner

*Primary Examiner*—John L Goodrow
(74) *Attorney, Agent, or Firm*—Oliff & Berridge, PLC

(57) ABSTRACT

Such a toner for developing an electrostatic image is to be provided that has a wide fixable temperature range, is excellent in development and transfer performance and excellent in releasing performance, realizes both glossiness and transparency, and is capable of providing an image (particularly a color image) of a wide color reproduction range having high quality and high durability, a developer for an electrostatic image, and a process for forming an image. The toner for developing an electrostatic image contains a binder resin, a colorant and an inorganic metallic salt, and an amount of a toluene insoluble component (provided that the colorant, a releasing agent and inorganic and organic insoluble particles are excluded therefrom) is from 0.5 to 10% by weight. The developer for an electrostatic image and the process for forming an image use the toner for developing an electrostatic image.

19 Claims, No Drawings

TONER FOR DEVELOPING ELECTROSTATIC IMAGE, DEVELOPER FOR ELECTROSTATIC IMAGE, AND PROCESS FOR FORMING IMAGE

BACKGROUND OF THE INVENTION

1. Field of the Invention

The present invention relates to a toner for developing an electrostatic image used for developing an electrostatic latent image formed by an electrophotographic process or an electrostatic recording process, a developer for an electrostatic image, and a process for forming an image.

2. Description of Related Art

A process for visualizing image information through an electrostatic image by an electrophotographic process has been utilized in various fields of art. In the electrophotographic process, an electrostatic image is formed on a photoreceptor by charging and exposing steps, and the electrostatic latent image is visualized by developing it with a developer containing a toner, followed by transferring and fixing steps. The developer used herein includes a two-component developer containing a toner and a carrier and a one-component developer formed solely with a magnetic toner or a non-magnetic toner. The toner is generally produced by a kneading and pulverizing process, in which a thermoplastic resin is melted and kneaded with a colorant, a charge controlling agent and a releasing agent, such as wax, and after cooling, the mixture is finely pulverized and classified. In order to improve the flowability and the cleaning property of the toner, inorganic or organic fine particles may be added to the surface of the toner particles, as required.

In recent years, duplicators and printers utilizing the color electrophotographic process and composite machine thereof with facsimile machines are quickly spread. In the case where moderate gloss upon reproduction of a color image and transparency for obtaining an excellent OHP image are to be realized, it is generally difficult to use a releasing agent, such as wax. Accordingly, a large amount of an oil is applied to a fixing roll for assisting release, but the oil causes sticky feeling of a duplicated image including an OHP image and difficulty in writing on the image with a pen, and uneven gloss feeling also sometimes occurs. Wax including polyethylene, polypropylene and paraffin, which is generally used for monochrome duplication, is more difficult to be used because it impairs the OHP transparency.

Even though the transparency is abandoned, it is difficult that exposure of the releasing agent to the toner surface is suppressed when the toner is produced by the conventional kneading and pulverizing process, and therefore, such problems as considerable deterioration of the flowability and filming on a developing unit and a photoreceptor are caused upon using as a developer.

As an ultimate solution for the problems, a process for producing a toner by such a polymerization process is proposed that an oily phase containing a monomer as a raw material of a resin and a colorant is dispersed in an aqueous phase, and the toner is directly polymerized to form a toner, whereby the wax is encompassed in the interior of the toner to control exposure thereof.

In addition to the above, as a method for enabling intentional control of the toner shape and the surface structure, production processes for a toner by a emulsion polymerization and aggregation process are proposed in Japanese Patent Laid-Open No. 282752/1988 and Japanese Patent Laid-Open No. 250439/1994. In these production processes, the following procedures are generally carried out. A resin dispersion is produced by emulsion polymerization, and separately, a colorant dispersion containing a colorant dispersed in a solvent is produced. They are mixed to form aggregates corresponding to the toner particle diameter, and then they are heated to coalesced, whereby a toner is produced.

These production processes not only realize internal inclusion of the wax, but also facilitate production of a toner of a small diameter, whereby clear image reproduction of high resolution is realized.

When these production processes are employed, the design of the characteristics of the resin becomes considerably important for attaining higher image quality. In order to realize a wide reproduction color gamut, it is necessary that not only the colorant is optimized, but also a gloss image of a certain level or higher is obtained by the melting characteristics of the resin. It is necessary therefore that the elasticity of the resin is decreased by decreasing the molecular weight to lower the melt viscosity thereof upon heating with a heat roll, whereby the resin is designed to increase the flowability thereof. However, when the elasticity is decreased, the adherability to the heat roll is increased, and thus release from the roll becomes difficult in the absence of a fixing oil even though a releasing agent, such as wax, is contained. Furthermore, hot offset at a high temperature due to the lowered molecular weight is liable to be a problem, and as a result, the toner often has a too narrow usable temperature range.

In this case, the fixing behavior becomes extremely sensitive to the temperature fall of a fixing heat roll and the temperature rise upon heating with a heater in continuous printing, and therefore, the temperature control becomes considerably difficult. In practice, influences of quality and thickness of paper on the temperature are to be also considered, whereby the control thereof becomes more complicated. Furthermore, when the molecular weight is decreased, the gloss is increased, but the fixed image becomes mechanically brittle to cause such a problem on durability of the image that the image is damaged upon folding the medium, such as paper.

As described in the foregoing, in order to provide a high quality image by the electrophotographic process and to maintain stable performance of a toner under various kinds of mechanical stress, it is necessary that the selection and the amount of the colorant and the releasing agent are optimized, and exposure of the releasing agent to the surface is suppressed, and also the following factors are extremely important, i.e., improvement of the gloss by optimization of the resin properties, and improvement of the releasing property and suppress of hot offset in the absence of a fixing oil. However, it is the current situation that further improvements are demanded.

SUMMARY OF THE INVENTION

Therefore, the invention has been developed to solve the problems associated with the conventional techniques to attain the following targets. The invention is to provide a toner for developing an electrostatic image that has a wide fixable temperature range, is excellent in development and transfer performance and excellent in releasing performance, realizes both glossiness and transparency, and is capable of providing an image (particularly a color image) of a wide color reproduction range having high quality and high durability, a developer for an electrostatic image, and a process for forming an image.

The invention relates to, as one aspect, a toner for developing an electrostatic image containing a binder resin, a colorant and an inorganic metallic salt. An amount of a toluene insoluble component (provided that the colorant, a releasing agent and inorganic and organic insoluble particles are excluded therefrom) is from 0.5 to 10% by weight.

The invention also relates to, as another aspect, a developer for an electrostatic image containing the toner and a carrier.

The invention also relates to, as a further aspect, a process for forming an image. The process contains the steps of: forming an electrostatic latent image on an electrostatic image holding member; developing the electrostatic latent image on a developer holding member with a developer for an electrostatic image containing a toner to form a toner image; transferring the toner image to a transfer material; and fixing the toner image with heat. The toner is the toner for developing an electrostatic image of the invention.

DESCRIPTION OF THE PREFERRED EMBODIMENTS

The invention will be described in detail.

The toner for developing an electrostatic image of the invention contains a binder resin, a colorant and an inorganic metallic salt, and an amount of a toluene insoluble component (provided that a colorant, a releasing agent and inorganic and organic insoluble particles are excluded therefrom) is from 0.5 to 10% by weight.

In general, a toner contains, for example, a colorant, such as a pigment, a releasing agent, such as wax, and inorganic and organic insoluble particles, and when the toner is dissolved in a solvent, the pigment, the releasing agent and the inorganic and organic insoluble particles can be separated as a toluene insoluble component. When a crosslinked component is contained in a toner, it is also detected as a toluene insoluble component. In particular, in the case where, upon production thereof, resin particles have polar groups, they easily form ionic crosslinking with metallic ions (inorganic metallic salt) having divalent or more electric charge to form a toluene insoluble component. It has been found that the toluene insoluble component excluding a pigment, a releasing agent and inorganic and organic insoluble particles greatly influences on the melt elastic behavior of the toner. That is, when the amount of the toluene insoluble component contained in the toner is large, gloss is difficult to be obtained, and when it is too small, wrapping on a fixing roll and hot offset due to releasing failure are caused.

From the foregoing standpoint, the toner for developing an electrostatic image of the invention contains a binder resin, a colorant and an inorganic metallic salt, and an amount of a toluene insoluble component (provided that a colorant, a releasing agent and inorganic and organic insoluble particles are excluded therefrom) is from 0.5 to 10% by weight, whereby the fixable temperature range is enhanced, excellent development and transfer performance and excellent releasing performance are provided, and both glossiness and transparency are realized, so as to obtain an image (particularly a color image) of a wide color reproduction range (so-called color gamut) having high quality and high durability.

The toluene insoluble component herein is a component excluding a colorant, a releasing agent and inorganic and organic insoluble particles, and the major component thereof is often a crosslinked component in the toner. Examples of the inorganic insoluble particles include fine particles of silica, titania, magnesia, calcium carbonate, alumina, cerium oxide and strontium titanate, and examples of the organic insoluble particles include fine particles of crosslinked polystyrene, polymethyl methacrylate, copolymers of analogous monomers, and a benzoguanamine resin, and crosslinked resin fine particles.

The amount of the toluene insoluble component (provided that a colorant, a releasing agent and inorganic and organic insoluble particles are excluded therefrom) is from 0.5 to 10% by weight, preferably from 1 to 8% by weight, and more preferably from 2 to 6% by weight. When the amount of the toluene insoluble component is less than 0.5% by weight, the fixable temperature range becomes too narrow due to occurrence of releasing failure and hot offset, and when it exceeds 10% by weight, the gloss of the fixed image becomes too low to narrow the color reproduction range.

The measurement of the toluene insoluble component can be carried out the following procedures.

Measurement of Toluene Insoluble Component (1) About 0.3 g of a sample (toner) is weighed precisely to a unit of 0.1 mg directly to a 25-ml flask (weight A).

(2) 20 g of toluene is put on the flask, and after sealing hermetically, the sample is dissolved at room temperature around 20° C. The solution obtained by dissolving the sample in toluene is then transferred to a 40-ml separation tube for centrifugal separation. Another 20 g of toluene is put in the empty flask to wash the interior thereof, and the resulting solution is also put in the separation tube for centrifugal separation. The separation tube is sealed and subjected to centrifugal separation (at −10° C. and 18,000 rpm for 20 minutes).

(3) A tare of an aluminum plate is precisely measured (weight B).

(4) After allowing to stand the separation tube until it is at room temperature, 5 g of a supernatant liquid in the separation tube is weighed with a pipette on the aluminum plate having been precisely weighed.

(5) The aluminum plate is heated to 80° C. to evaporate the toluene component, and the sample is completely dried in a vacuum dryer and weighed (weight C).

After carrying out the foregoing procedures (1) to (5), the amount of the toluene insoluble component excluding a pigment, a releasing agent and inorganic and organic insoluble particles is calculated by the following equation.

$$\text{toluene insoluble component (\%)} = ((A-(C-B)\times 8)/A\times 100)-(\text{pigment (\%)}+\text{releasing agent (\%)}+\text{inorganic and organic insoluble particles (\%)})$$

The amounts of a colorant (pigment), a releasing agent and inorganic and organic insoluble particles can be obtained from the values in part by weight upon weighing in production of the sample or measured from analytical values of fluorescent X-ray analysis, atomic absorption spectrometry analysis or differential scanning calorimetry.

The toluene insoluble component can be controlled, for example, by controlling the amount of an inorganic metallic salt that is added upon aggregation of the resin particles, the colorant and the releasing agent, and by adjusting appropriately the concentration or the acid value of releasing polar groups in the resin particles and the pH conditions upon coalescing after reaching the target particle diameter through aggregation. In particular, it is considered that the amount of the toluene insoluble component is controlled by the number of groups forming ion crosslinking and the dissociation conditions thereof upon formation. When the amount of the inorganic metallic salt is increased, there is a tendency that the amount of the toluene insoluble component is increased, and when it is decreased, there is a tendency that the amount of the toluene insoluble component is decreased.

The toner for developing an electrostatic image of the invention preferably has a shape factor SF1 of 140 or less to obtain excellent charge characteristics, cleaning property and transfer property, and it is more preferably from 110 to 135. When the shape factor SF1 exceeds 140, the transfer efficiency from the electrostatic image holding member holding the toner image to the transfer material is lowered to impair the reliability of image quality. The cleaning property referred herein is that with respect to cleaning by the blade method, which is the most popular method.

The shape factor SF1 is obtained in the following manner. An optical micrograph of the toner scattered on slide glass is imported to a Luzex image analyzer through a video camera, and the peripheral maximum length (ML) and the projected area (A) are measured for 50 or more toner particles. The shape factor SF1 is a value obtained therefrom by the equation (square of maximum length)/(projected area)=$ML^2/A$.

The toner for developing an electrostatic image of the invention preferably has a surface property index represented by the following equation (A) of 2.0 or less because good transfer property is obtained, and in particular, uniform and high image quality with high transfer efficiency is realized for paper and a transfer material having a large surface roughness, and it is more preferably from 1.0 to 2.0, and further preferably from 1.0 to 1.8.

$$\text{surface property index}=(\text{measured specific surface area})/(\text{calculated specific surface area}) \quad (A)$$

The calculated specific surface area herein is obtained by the following equation.

$$\text{calculated specific surface area}=6\Sigma(n\times R^2)/(\rho\cdot\Sigma(n\times R^3))$$

wherein n represents the number of particles of the toner present in a channel of a Coulter counter, R represents a channel particle diameter ($\mu$m) in the Coulter counter, and ρ represents the toner density (g/cm$^2$) and the Coulter counter has 16 channels (divided number: dividing the area of from 1 to 50 $\mu$m into 16 pieces).

The measured specific surface area is measured by the gas adsorption/desorption method, and it can be obtained by measuring the Langmuir specific surface area. As the measuring apparatus, for example, Coulter Model SA3100 (produced by Beckman Coulter, Inc.) and Gemini 2360/2375 (produced by Shimadzu Corp.) can be used.

As a method for controlling the surface property index represented by the equation (A), for example, it can be controlled by adjusting appropriately the temperature and the pH upon fusing and coalescing the aggregated particles containing the resin particles.

The toner for developing an electrostatic image of the invention preferably has an apparent weight average molecular weight in a range of from 15,000 to 55,000, and more preferably in a range of from 20,000 to 48,000. When the weight average molecular weight is lower than 15,000, there are some cases where the cohesive force of the binder resin is lowered to deteriorate the oilless releasing property, and when it exceeds 55,000, there are some cases where the smoothness upon fixing becomes poor while the oilless releasing property is good, whereby the glossiness is lowered.

The toner for developing an electrostatic image of the invention preferably has a glass transition point Tg in a range of from 45 to 65° C., and more preferably in a range of from 48 to 60° C. When Tg is lower than 45° C., the cohesive force of the binder resin itself at a high temperature range is lowered, and hot offset is liable to occur upon fixing, and when it exceeds 65° C., there are some cases where sufficient fusion cannot be obtained to lower the glossiness of the fixing sheet.

The toner for developing an electrostatic image of the invention preferably has an accumulated volume average particle diameter $D_{50V}$ in a range of from 3.0 to 9.0 $\mu$m, more preferably in a range of from 3.0 to 8.0 $\mu$m, and in the invention further preferably in a range of from 4 to 6 $\mu$m. In particular, when $D_{50V}$ is in a range of from 4 to 6 $\mu$m, it is preferred from the standpoint that uniform glossiness can be obtained. When $D_{50V}$ is lower than 3.0 $\mu$m, there are some cases where the charging property is insufficient, and the developing property is lowered. When it exceeds 9.0 $\mu$m, the resolution property of the image is lowered.

The toner for developing an electrostatic image of the invention preferably has a volume average particle size distribution index GSDv of 1.30 or less. When GSDv exceeds 1.30, there are some cases where the resolution property is lowered, which becomes a factor of image defects, such as scattering of the toner and fogging.

The accumulated average particle diameter and the average particle size distribution index can be calculated in the following manner. The particle size distribution is measured, for example, by a measuring apparatus, such as Coulter Counter TAII (produced by Nikkaki Co., Ltd.) and Multisizer II (produced by Nikkaki Co., Ltd.). Based on the particle size distribution, the values of volume and number for the divided particle size areas (divided number: dividing the area of from 1 to 50 $\mu$m into 16 pieces) are obtained, and accumulated distribution curves thereof are drawn from the small particle size side. The particle diameters at the volume and the number of accumulation of 16% are defined as $D_{16V}$ and $D_{16P}$, respectively, the particle diameters at the volume and the number of accumulation of 50% are defined as $D_{50V}$ and $D_{50P}$, respectively, and the particle diameters at the volume and the number of accumulation of 84% are defined as $D_{84V}$ and $D_{84P}$, respectively. By using these values, the volume average particle size distribution index (GSDv) is calculated as $(D_{84V}/D_{16V})^{1/2}$, and the number average particle size distribution index (GSDp) is calculated as $(D_{84P}/D_{16P})^{1/2}$.

The toner for developing an electrostatic image of the invention is preferably produced by the following wet production process because a toner having a small diameter and the sharp particle size distribution described in the foregoing can be obtained. The wet production process contains steps of: aggregating a particle group in a dispersion containing the particle group containing at least resin particles, and an inorganic metallic salt, to obtain aggregated particles; and heating the aggregated particles to coalesce them. Such is suitable from the viewpoint that high-image quality full-color images can be formed. Particularly, in this wet production process, in the case where the amount of the toluene insoluble component is increased by aggregating the resin particles with the inorganic metallic salt, the toluene insoluble component is uniformly incorporated into the toner particles in comparison to the conventional toners produced by the pulverization process, whereby fluctuation in composition among the toner particles is reduced. In the case where crosslinking is effected upon melting and kneading in the conventional pulverization process, because the inorganic metallic particles are dispersed in the resin, crosslinked matters are partially formed, whereby parts having a large gel content (toluene insoluble component) are not pulverized to form a toner having a large gel content and a toner having a small gel content.

In the foregoing process step for obtaining the aggregated particles, in addition to the particle group containing the resin particles, and the inorganic metallic salt, a colorant (particles) and a releasing agent (particles) may be used in the particle group depending on necessity. Known internal additives, such as a charge controlling agent, may also be used as additives.

The inorganic metallic salt can be obtained by dissolving an ordinary inorganic metallic compound or a polymer thereof in the resin particle dispersion. A metallic element constituting the inorganic metallic salt is having a charge of divalent or more belonging to the 2A, 3A, 4A, 5A, 6A, 7A, 8, 1B, 2B and 3B groups of the periodic table (long form periodic table), and it is preferably one that is dissolved in the form of ions in the aggregated system of the resin particles, i.e., a so-called water soluble metallic salt. Specific and preferred examples of the inorganic metallic salt include metallic salts, such as calcium chloride, calcium nitrate, barium chloride, magnesium chloride, zinc chloride, aluminum chloride and aluminum sulfate, and an inorganic metallic salt polymer, such as polyaluminum chloride, polyaluminum hydroxide and polycalcium sulfide. Among these, an aluminum salt and a polymer thereof are particularly preferred. In general, in order to obtain a shaper particle size distribution, the valence number of the inorganic metallic salt is preferably larger, i.e., divalent is better than monovalent, and trivalent is better than divalent, and in the case of the same valence number, an inorganic metallic salt polymer is more preferred.

Examples of the binder resin used as the resin fine particles include a homopolymer and a copolymer of a vinyl monomer, e.g., a styrene compound, such as styrene and parachlorostyrene, a vinyl ester, such as vinylnaphthalene, vinyl chloride, vinyl bromide, vinyl fluoride, vinyl acetate, vinyl propionate, vinyl benzoate and vinyl butyrate, a methylene aliphatic carboxylate ester, such as methyl acrylate, ethyl acrylate, n-butyl acrylate, isobutyl acrylate, dodecyl acrylate, n-octyl acrylate, 2-chloroethyl acrylate, phenyl acrylate, methyl α-chloroacrylate, methyl methacrylate, ethyl methacrylate and butyl methacrylate, acrylonitrile, methacrylonitrile, acrylamide, a vinyl ether, such as vinyl methyl ether, vinyl ethyl ether and vinyl isobutyl ether, a monomer having an N-containing polar group, such as N-vinylpyrrol, N-vinylcarbazole, N-vinylindol and N-vinylpyrrolidone, metacrylic acid, acrylic acid, cinnamic acid, and a vinyl carboxylic acid, such as carboxyethyl acrylate, and/or various kinds of polyester, and various kinds of wax may also be used in combination.

In the case where the binder resin is formed from a vinyl monomer, it can be produced in such a manner that emulsion polymerization is carried out by using an ionic surfactant to produce a resin particle dispersion. In the case of other resins that are oleophilic and are dissolved in a solvent having relatively low solubility in water, the resin is dissolved in the solvent and dispersed in the form of particles in water along with an ionic surfactant and a polymer electrolyte by using a disperser, such as a homogenizer, followed by evaporating the solvent by heating or under reduced pressure, whereby a resin particle dispersion can be obtained.

The resin particles in the resin particle dispersion preferably have a center diameter (median diameter) of 1 μm or less, more preferably from 50 to 400 nm, and further preferably from 70 to 350 nm.

The center diameter (median diameter) of the resin particle can be measured, for example, with a laser diffraction particle size distribution measuring apparatus (LA-700, produced by Horiba, Ltd.).

As the colorant (particles), the following materials can be preferably used.

Examples of a black pigment include carbon black, copper oxide, manganese dioxide, aniline black, activated carbon, non-magnetic ferrite and magnetite.

Examples of a yellow pigment include chrome yellow, zinc yellow, yellow iron oxide, cadmium yellow, chrome yellow, hansa yellow, hansa yellow 10G, benzidine yellow G, benzidine yellow GR, suren yellow, quinoline yellow and permanent yellow NCG.

Examples of an orange pigment include red chrome yellow, molybdenum orange, permanent orange GTR, pyrazolone orange, vulkan orange, benzidine orange G, indanthrene brilliant orange RK and indanthrene brilliant orange GK.

Examples of a red pigment include red iron oxide, cadmium red, red lead, mercury sulfide, watchyoung red, permanent red 4R, lithol red, brilliant carmine 3B, brilliant carmine 6B, Du Pont oil red, pyrazolone red, rhodamine B lake, lake red C, rose bengal, eosine red and alizarine lake.

Examples of a blue pigment include iron blue, cobalt blue, alkali lake blue, victoria blue lake, fast sky blue, indanthrene blue BC, aniline blue, ultramarine blue, calco oil blue, methylene blue chloride, phthalocyanine blue, phthalocyanine green and malachite green oxalate.

Examples of a violet pigment include manganese violet, fast violet B and methyl violet lake.

Examples of a green pigment include chromium oxide, chromium green, pigment green, malachite green lake and final yellow green G.

Examples of a white pigment include zinc flower, titanium oxide, antimony white and zinc sulfide.

Examples of a body pigment include barite powder, barium carbonate, clay, silica, white carbon, talc and alumina white.

Examples of a dye include various kinds of dye including basic, acidic, dispersed and direct dyes, for example, nigrosine, methylene blue, rose bengal, quinoline yellow and ultramarine blue.

A magnetic toner can be obtained by using a magnetic material as the whole or part a black colorant among the colorants. A magnetic material may be added separately from the colorant. The magnetic material used herein is a substance that is magnetized in a magnetic field, and specific examples thereof are compounds such as ferromagnetic powder, such as iron (including reduced iron), cobalt, nickel and manganese, ferrite and magnetite. In the case where the toner is obtained in an aqueous phase, it is necessary to pay attention to the aqueous phase transition property of the magnetic material, and it is preferred that the surface of the magnetic material is previously modified, for example, subjected to a hydrophobic treatment.

These colorants are used solely or as a mixture. A dispersion of colorant particles is prepared by dispersing the colorant by using, for example, a revolving shearing homogenizer, a media disperser, such as a ball mill, a sand mill and an attritor, or a high pressure counter collision type disperser. The colorant may be dispersed in an aqueous system with a homogenizer by using a surfactant having polarity. In particular, it is preferred that the colorant is selected in view of hue, chroma, brightness, weather resistance, OHP transparency and dispersibility in the toner.

It is preferred that the colorant is added in an amount of from 4 to 15% by weight based on the total weight of the solid content constituting the toner, and in the case where a magnetic material is used as a black colorant, it is preferably added in an amount of from 12 to 240% by weight, which is different from those for the other colorants. The mixed amount of the colorant is the necessary amount for obtaining the coloring property upon fixing, and therefore, it is not limited to the foregoing ranges. The colorant (colorant particles) in the toner preferably has a center diameter (median diameter) of from 100 to 330 nm, and the OHP transparency and the coloring property can be assured by using the range.

The center diameter of the colorant (colorant particles) can be measured, for example, with a laser diffraction particle size distribution measuring apparatus (LA-700, produced by Horiba, Ltd.).

Examples of the releasing agent (particles) include a low molecular weight polyolefin, such as polyethylene, polypropylene and polybutene, a silicone exhibiting a softening point upon heating, an aliphatic amide, such as oleic amide, erucic amide, recinoleic amide and stearic amide, vegetable wax, such as carnauba wax, rice wax, candelilla wax, haze wax and jojoba oil, animal wax, such as yellow beeswax, mineral or petroleum wax, such as montan wax, ozokerite, ceresin, paraffin wax, microcrystalline wax and Fischer-Tropsch wax, and denatured materials thereof. The wax is substantially not dissolved in a solvent, such as toluene, around room temperature, or even through it is dissolved, only a slight amount thereof is dissolved. A dispersion of the wax can be obtained in such a manner that the wax is dispersed in water along with an ionic surfactant or a polymer electrolyte, such as a polymer acid and a polymer base, and it is heated to a temperature higher than the melting point thereof and dispersed into fine particles with a homogenizer or a pressure discharge disperser (Gaulin Homogenizer, produced by Gaulin Corp.) capable of applying a strong shearing force, whereby a particle dispersion of 1 $\mu$m or less can be prepared.

The particle diameter of the releasing agent particles can be measured, for example, with a laser diffraction particle size distribution measuring apparatus (LA-700, produced by Horiba, Ltd.). Upon using the releasing agent, it is preferred that after aggregating the resin particles, the colorant particles and the releasing agent particles, the resin particle dispersion is further added to attach the resin particles on the surface of the aggregated particles, in order to assure the charging property and the durability.

The releasing agent is preferably added (contained) in an amount of 10% by weight or more based on the total weight of the solid content constituting the toner, in order to assure the releasing property of the fixed image in the oilless fixing system, and it is more preferably in a range of from 10 to 25% by weight.

As the charge controlling agent, various kinds of charge controlling agents, which are ordinarily used, such as a quaternary ammonium salt compound, a nigrosine compound, a dye containing a complex of aluminum, iron or chromium, and a triphenylmethane pigment, can be used, and such materials that are difficult to be dissolved in water are preferred from the standpoint of control of the ion intensity, which influences on the stability upon aggregation and uniting, and reduction of contamination due to waste water.

A surfactant can be used upon emulsion polymerization and seed polymerization of the binder resin, dispersion of the colorant (particles), dispersion of resin fine particles, dispersion of the releasing agent (particles), aggregation and stabilization of the aggregated particles. Specific examples of the surfactant include an anionic surfactant, such as sulfate ester series, sulfonate series, phosphate ester series and soap series, and a cationic surfactant, such as amine salt type and quaternary ammonium salt type. It is also effective to use a nonionic surfactant, such as polyethylene glycol series, alkylphenol ethylene oxide series and polyvalent alcohol series, in combination. As the dispersion method, those are generally employed, such as a revolving shearing homogenizer, a media disperser, such as a ball mill, a sand mill and a dynomill.

Subsequent to the process step for obtaining the aggregated particles described in the foregoing, a process step for fusing the aggregated particles by heating (fusing and coalescing step) is carried out. After completing the fusing and coalescing step, a washing step, a solid-liquid separating step and a drying step are arbitrarily carried out depending on necessity, so as to obtain the desired toner (toner particles). In the washing step, it is preferred to carry out sufficient washing with ion exchanged water from the standpoint of charging property. The solid-liquid separating step is not particularly limited, suction filtration and pressure filtration are preferred from the standpoint of productivity. The drying step is also not particularly limited, and freeze-drying, flash jet drying, flowing drying and vibration flowing drying are preferably employed from the standpoint of productivity.

With respect to the production process of a toner by a wet production process using an inorganic metallic salt, for example, the emulsion aggregation process using a water soluble inorganic metallic salt having divalent or more electric charge disclosed in Japanese Patent No. 3,107,062 can be preferably employed, in which resin particles and other particles are aggregated in an aqueous medium using an inorganic metallic salt having a divalent or more electric charge, the pH of the aggregated particle dispersion is adjusted to a range of from 2 to 14, and preferably from 3 to 10, and then, after stabilizing the aggregated particles, they are coalesced by heating.

As similar to the ordinary toners, in order to apply flowability and to improve the cleaning property, it is possible that the toner for developing an electrostatic image of the invention is dried, and fine particles are added to the surface of the toner particles (so-called external additive) in a dry state under application of a sharing force. Examples of the fine particles include inorganic fine particles, such as silica, alumina, titania and calcium carbonate, and resin fine particles, such as a vinyl resin, polyester and silicone.

In the case where the fine particles are attached to the toner surface (external additive) in water, as examples of the inorganic fine particles, all the materials that are ordinarily used as an external additive, such as silica, alumina, titania, calcium carbonate, magnesium carbonate and tricalcium phosphate, can be used after dispersing with an ionic surfactant, a polymer acid or a polymer base.

(Developer for Electrostatic Image)

In the case where a magnetic material is added to the toner for developing an electrostatic image of the invention, or in the case where a magnetic material is added thereto as the whole or part of the black colorant thereof, the toner can be used as the one-component developer for an electrostatic image of the invention. The toner for developing an electrostatic image of the invention can also be used as the two-component developer for an electrostatic image of the invention by adding a carrier thereto.

The carrier is not particularly limited, and examples thereof include those having been known in the art. Among these, a resin-coated carrier is preferably used. As the resin-coated carrier, such known carriers can be used as the resin-coated carriers disclosed in Japanese Patent Laid-Open No. 39879/1987 and Japanese Patent Laid-Open No. 11461/1981. Examples thereof include the following resin-coated carriers. Examples of core particles of the carriers include ordinary ones, such as iron powder, ferrite and magnetite granulated materials, and the average particle diameter thereof is generally about from 30 to 200 $\mu$m. Examples of a resin coated on the core particles include a homopolymer of a monomer, e.g., a styrene compound, such as styrene, parachlorostyrene and a-methylstyrene, an $\alpha$-methylene aliphatic monocarboxylate, such as methyl acrylate, ethyl acrylate, n-propyl acrylate, lauryl acrylate, 2-ethylhexyl acrylate, methyl methacrylate, n-propyl methacrylate, lauryl methacrylate and 2-ethylhexyl methacrylate, a nitrogen-containing acrylic compound, such as dimethylaminoethyl methacrylate, a vinyl nitrile, such as acrylonitrile and methacrylonitrile, a vinylpyridine, such as 2-vinylpyridine and 4-vinylpyridine, a vinyl ether, such as vinyl methyl ether and vinyl isobutyl ether, a vinyl ketone, such as vinyl methyl ketone, vinyl ethyl ketone and vinyl isopropenyl ketone, an olefin, such as ethylene and propylene, and a vinyl series fluorine-containing monomer, such as vinylidene fluoride, tetrafluoroethylene and hexafluoropropylene, a copolymer of two or more of these monomers, a silicone, such as methyl silicone and methylphenyl silicone, polyester containing bisphenol or glycol, an epoxy resin, a polyurethane resin, a polyamide resin, a cellulose resin, a polyether resin, and a polycarbonate resin. These resins may be used solely or in combination of two or more kinds thereof. The amount of the coating resin is generally about from 0.1 to 10 parts by weight based on the core particles, and preferably from 0.5 to 3.0 parts by weight. Upon producing the carrier, a heating kneader, a heating Henschel mixer and a UM mixer can be used, and depending on the amount of the coating resin, a heating fluidized rolling bed and a heating kiln may also be used. The mixing ratio of the toner for developing an electrostatic image of the invention and the carrier is not particularly limited and can be appropriately selected depending on purposes.

(Process for Forming Image)

The process for forming an image of the invention contains steps of: forming an electrostatic latent image on a electrostatic image holding member; developing the electrostatic latent image on an electrostatic image holding member with a developer containing a toner to form a toner image; transferring the toner image to a transfer material; and fixing the toner image with heat, in which the toner for developing an electrostatic image of the invention is used as the toner.

In the process for forming an image of the invention, the respective steps themselves are those having been known and disclosed, for example, in Japanese Patent Laid-Open No. 40868/1981 and Japanese Patent Laid-Open No. 91231/1974, which can be applied to the invention. The process for forming an image of the invention can be practiced by using an image forming apparatus having been known, such as a duplicator and a facsimile machine.

EXAMPLES

The invention will be described in more detail with reference to the following examples, but the examples do not restrict the invention in any way. The measurements are carried out according the manner described in the foregoing.

The toner is produced in the following manner. The resin fine particle dispersion, the colorant particle dispersion and the releasing agent particle dispersion described below are respectively prepared and mixed at a prescribed ratio. A polymer of an inorganic metallic compound (inorganic metallic salt) is added thereto under stirring, and thus it is ionically neutralized to form aggregated particles. After adding an inorganic hydroxide thereto to adjust the pH of the system from weak acidic condition to neutral condition, they are heated to a temperature higher than the glass transition point of the resin particles to effect fusion and coalescing. After completing the reaction, sufficient washing, solid-liquid separation and drying steps are carried out to produce the objective toner. The respective methods of preparation will be described below.

| (Preparation of Resin Particle Dispersion (1)) | |
|---|---|
| Styrene | 460 parts by weight |
| n-Butyl acrylate | 140 parts by weight |
| Acrylic acid | 12 parts by weight |
| Dodecanethiol | 9 parts by weight |

The foregoing components are mixed and dissolved to prepare a solution. 12 parts by weight of an anionic surfactant (Dowfax, produced by Rhodia, Inc.) is dissolved in 250 parts by weight of ion exchanged water, and the solution is added thereto to effect dispersion and emulsification (monomer emulsion A) in a flask. Furthermore, 1 part by weight of an anionic surfactant (Dowfax, produced by Rhodia, Inc.) is dissolved in 555 parts by weight of ion exchanged water and charged in a polymerization flask. The polymerization flask is sealed, and a reflux tube is set. Under slowly stirring with injecting nitrogen, the polymerization flask is heated to 75° C. over a water bath, and the temperature is maintained. 9 parts by weight of ammonium persulfate are dissolved in 43 parts by weight of ion exchanged water, and the resulting solution is added dropwise to the polymerization flask over 20 minutes by using a metering pump. The monomer emulsion A is then also added dropwise thereto over 200 minutes by using a metering pump. Thereafter, the polymerization flask is maintained at 75° C. for 3 hours under slowly stirring to complete polymerization.

As a result, an anionic resin particle dispersion (1) having a solid content of 42% and containing particles having a center diameter of 210 nm, a glass transition point of 53.5° C. and a weight average molecular weight of 31,000 is prepared.

(Preparation of Resin Particle Dispersion (2))

An anionic resin particle dispersion (2) having a solid content of 42% and containing fine particles having a center diameter of 190 nm, a glass transition point of 51.0° C. and a weight average molecular weight of 24,500 is prepared in the same manner as in the preparation of the resin particle dispersion (1) except that the amount of acrylic acid is changed to 9 parts by weight, and the amount of dodecanethiol is changed to 12 parts by weight.

| (Preparation of Colorant Particle Dispersion (1)) | |
|---|---|
| Yellow pigment (PY180, produced by Clariant Japan Co., Ltd.) | 50 parts by weight |
| Anionic surfactant (Neogen R, produced by Dai-ichi Kogyo Seiyaku Co., Ltd.) | 5 parts by weight |
| Ion exchanged water | 200 parts by weight |

The foregoing components are mixed and dissolved and dispersed for 10 minutes with a homogenizer (Ultra-Turrax, produced by IKA Works, Inc.), so as to prepare a yellow colorant particle dispersion (1) having a center diameter of 210 nm and a solid content of 21.5%.

(Preparation of Colorant Particle Dispersion (2))

A cyan colorant particle dispersion (2) having a center diameter of 190 nm and a solid content of 21.5% is prepared in the same manner as in the preparation of the colorant particle dispersion (1) except that a cyan pigment (Copper Phthalocyanine B15:3, produced by Dainichiseika Colour & Chemicals Mfg. Co., Ltd.) is used instead of the yellow pigment.

(Preparation of Colorant Particle Dispersion (3))

A magenta colorant particle dispersion (3) having a center diameter of 165 nm and a solid content of 21.5% is prepared in the same manner as in the preparation of the colorant particle dispersion (1) except that a magenta pigment (PR122, produced by Dainippon Ink And Chemicals, Inc.) is used instead of the yellow pigment.

(Preparation of Colorant Particle Dispersion (4))

A black colorant particle dispersion (4) having a center diameter of 170 nm and a solid content of 21.5% is prepared in the same manner as in the preparation of the colorant particle dispersion (1) except that a black pigment (carbon black, produced by Cabot, Inc.) is used instead of the yellow pigment.

| (Preparation of Releasing Agent Particle Dispersion) | |
|---|---|
| Paraffin wax<br>(HNPO190, produced by Nippon Seiro Co., Ltd.)<br>(melting point: 85° C.) | 50 parts by weight |
| Anionic surfactant<br>(Dowfax, produced by Rhodia, Inc.) | 5 parts by weight |
| Ion exchanged water | 200 parts by weight |

The foregoing components are heated to 95° C. and sufficiently dispersed in a homogenizer (Ultra-Turrax T50, produced by IKA Works, Inc.), and then they are subjected to a dispersion treatment with a pressure discharge homogenizer (Gaulin Homogenizer, produced by Gaulin Corp.), so as to prepare a releasing agent particle dispersion having a center diameter of 180 nm and a solid content of 21.5%.

Example 1

| (Preparation of Toner Particles) | |
|---|---|
| Resin particle dispersion (1) | 200 parts by weight<br>(resin:<br>84 parts by weight) |
| Colorant particle dispersion (1) | 40 parts by weight<br>(pigment:<br>8.6 parts by weight) |
| Releasing agent particle dispersion | 40 parts by weight<br>(releasing agent:<br>8.6 parts by weight) |
| Polyaluminum chloride | 0.15 part by weight |

The foregoing components are sufficiently mixed and dispersed in a round-bottom stainless steel flask with a homogenizer (Ultra-Turrax T50, produced by IKA Works, Inc.). The flask is then heated to 48° C. over a heating oil bath under stirring, and after maintaining at 48° C. for 60 minutes, 68 parts by weight of the resin particle dispersion (1) (resin: 28.56 parts by weight) are added thereto and gradually stirred (the step of obtaining aggregated particles).

Thereafter, the pH in the system is adjusted to 6.0 with a 0.5 mol/L sodium hydroxide aqueous solution, and then the system is heated to 95° C. under continuous stirring. During the period where the temperature is increased to 95° C., the pH in the system is decreased to 5.0 in the ordinary cases, and at this time, the sodium hydroxide aqueous solution is additionally added dropwise to maintain the pH not underrunning 5.5. After completing the reaction (coalescence), the system is cooled, filtrated and sufficiently washed with ion exchanged water, followed by subjecting to solid-liquid separation by Nutsche suction filtration. The solid content is subjected to a washing operation by again dispersing in 3 L of ion exchanged water at 40° C., and then being washed by stirring for 15 minutes at 300 rpm. The washing operation is repeated five times, and the solid content is subjected to solid-liquid separation by Nutsche suction filtration, followed by vacuum drying for 12 hours, to obtain a toner (toner particles).

The resulting toner (toner particles) is measured for particle diameter with a Coulter counter, and it is found that the accumulated volume average particle diameter $D_{50V}$ is 5.6 $\mu$m, the volume average particle size distribution index GSDv is 1.20, and the surface property index represented by the equation (A) is 1.55. The shape factor SF1 of the toner particles obtained by shape observation with a Luzex image analyzer is 128, which indicates a potato-like shape. The amount of a toluene insoluble component of the toner is measured, and thus it is 5.4% by weight. 1.2 parts by weight of hydrophobic silica (TS720, produced by Cabot, Inc.) are added to 50 parts by weight of the resulting toner (toner particles) and mixed with a sample mill to obtain an external addition toner.

The external addition toner is mixed with a ferrite carrier of an average particle diameter of 50 $\mu$m having polymethyl methacrylate (produced by Soken Chemical & Engineering Co., Ltd.) coated in an amount of 1% to a toner concentration of 5%, and they are stirred and mixed for 5 minutes with a ball mill to prepare a developer.

(Evaluation of Toner)

The fixing property of the toner is evaluated by using the developer in a modified machine of Acolor 953, produced by Fuji Xerox Co., Ltd., by using J coat paper, produced by Fuji Xerox Co., Ltd., as transfer paper, at a process speed adjusted to 180 mm/sec, and it is found that the oilless fixing property with a PFA tube fixing roll is satisfactory, and it is confirmed, at 140° C. or higher (the lowest fixing temperature is evaluated from contamination of the image upon rubbing the image with cloth), that the image exhibits sufficient fixing property, and the transfer paper is released without any problem. The image obtained at a fixing temperature of 180° C. has a satisfactory surface glossiness (the glossiness is measured with a glossiness measuring apparatus (Model GM-26D, produced by Murakami Color Research Laboratory, Inc.) of 65% with good developing property and transfer property, and the image exhibits high chroma.

Occurrence of hot offset is not observed at a fixing temperature of 220° C.

The fixing property of the toner is similarly evaluated by using an OHP sheet (for monochrome printing, produced by Fuji Xerox Co., Ltd.), and it is found that an image on the OHP sheet has good transparency, and a transparent image without turbidity is confirmed.

Example 2

A toner (toner particles) is obtained in the same manner as in Example 1 except that the resin particle dispersion (1) is changed to the resin particle dispersion (2), the colorant particle dispersion (1) is changed to the colorant particle dispersion (2), and the pH upon heating to 95° C. is changed to 5.0 maintained.

The resulting toner (toner particles) has an accumulated volume average particle diameter $D_{50V}$ of 5.40 μm, a volume average particle size distribution index GSDv of 1.19 and a surface property index represented by the equation (A) of 1.32. The shape factor SF1 is 124, which indicates a rather spherical shape. The amount of a toluene insoluble component of the toner is 2.8% by weight.

An external addition toner is obtained by using the resulting toner (toner particles) in the same manner as in Example 1 to prepare a developer. The fixing property of the toner is then evaluated in the same manner as in Example 1, and it is found that the oilless fixing property with a PFA tube fixing roll is satisfactory, and it is confirmed, at 135° C. or higher, that the image exhibits sufficient fixing property, and the transfer paper is released without any problem. The image obtained at a fixing temperature of 180° C. has a satisfactory surface glossiness of 76% with good developing property and transfer property, and the image exhibits high chroma.

Occurrence of hot offset is not observed at a fixing temperature of 220° C.

The fixing property of the toner is similarly evaluated by using an OHP sheet (for monochrome printing, produced by Fuji Xerox Co., Ltd.), and it is found that an image on the OHP sheet has good transparency, and a transparent image without turbidity is confirmed.

Example 3

A toner (toner particles) is obtained in the same manner as in Example 2 except that the colorant particle dispersion (2) is changed to the colorant particle dispersion (3), and the amount of polyaluminum chloride is changed to 0.12 part by weight.

The resulting toner has an accumulated volume average particle diameter $D_{50V}$ of 5.32 μm, a volume average particle size distribution index GSDv of 1.22 and a surface property index represented by the equation (A) of 1.20. The shape factor SF1 is 119, which indicates a spherical shape. The amount of a toluene insoluble component of the toner is 0.8% by weight.

An external addition toner is obtained by using the resulting toner (toner particles) in the same manner as in Example 1 to prepare a developer. The fixing property of the toner is then evaluated in the same manner as in Example 1, and it is found that the oilless fixing property with a PFA tube fixing roll is satisfactory, and it is confirmed, at 135° C. or higher, that the image exhibits sufficient fixing property, and the transfer paper is released without any problem. The image obtained at a fixing temperature of 180° C. has a satisfactory surface glossiness of 85% with good developing property and transfer property, and the image exhibits high chroma.

Occurrence of hot offset is not observed at a fixing temperature of 210° C., and slight occurrence thereof is found at 220° C., which is, however, such an extent that does not cause any practical problem.

The fixing property of the toner is similarly evaluated by using an OHP sheet (for monochrome printing, produced by Fuji Xerox Co., Ltd.), and it is found that an image on the OHP sheet has good transparency, and a transparent image without turbidity is confirmed.

Example 4

A toner (toner particles) is obtained in the same manner as in Example 1 except that the amount of polyaluminum chloride is changed to 0.25 part by weight.

The resulting toner has an accumulated volume average particle diameter $D_{50V}$ of 5.92 μm, a volume average particle size distribution index GSDv of 1.22 and a surface property index represented by the equation (A) of 1.20. The shape factor SF1 is 135, which indicates a potato-like shape. The amount of a toluene insoluble component of the toner is 9.5% by weight.

An external addition toner is obtained by using the resulting toner (toner particles) in the same manner as in Example 1 to prepare a developer. The fixing property of the toner is then evaluated in the same manner as in Example 1, and it is found that the oilless fixing property with a PFA tube fixing roll is satisfactory, and it is confirmed, at 140° C. or higher, that the image exhibits sufficient fixing property, and the transfer paper is released without any problem. The image obtained at a fixing temperature of 180° C. has a surface glossiness of 48%, which is slightly low but satisfactory, with good developing property and transfer property, and the image exhibits high chroma.

Occurrence of hot offset is not observed at a fixing temperature of 220° C.

The fixing property of the toner is similarly evaluated by using an OHP sheet (for monochrome printing, produced by Fuji Xerox Co., Ltd.), and it is found that an image on the OHP sheet has good transparency, and a transparent image without turbidity is confirmed.

Comparative Example 1

A toner (toner particles) is obtained in the same manner as in Example 2 except that the colorant particle dispersion (2) is changed to the colorant particle dispersion (3), the amount of polyaluminum chloride is changed to 0.10 part by weight, and the pH after heating to 95° C. is adjusted to 4.0.

The resulting toner has an accumulated volume average particle diameter $D_{50V}$ of 5.45 μm, a volume average particle size distribution index GSDv of 1.25 and a surface property index represented by the equation (A) of 1.15. The shape factor SF1 is 115, which indicates a spherical shape. The amount of a toluene insoluble component of the toner is 0.4% by weight.

An external addition toner is obtained by using the resulting toner (toner particles) in the same manner as in Example 1 to prepare a developer. The fixing property of the toner is then evaluated in the same manner as in Example 1, and it is found that the oilless fixing property with a PFA tube fixing roll is satisfactory, and it is confirmed, at 130° C. or higher, that the image exhibits sufficient fixing property, but the transfer paper is insufficiently released, and undulating and wrapping of the paper are observed after fixing. Occurrence of hot offset is observed from a fixing temperature of 180° C., and the evaluation of glossiness cannot be carried out.

Comparative Example 2

A toner (toner particles) is obtained in the same manner as in Example 1 except that the amount of polyaluminum chloride is changed to 0.25 part by weight, and the pH upon heating to 95° C. is adjusted not to become 7 or less.

The resulting toner has an accumulated volume average particle diameter $D_{50V}$ of 5.62 μm, a volume average particle size distribution index GSDv of 1.26 and a surface property index represented by the equation (A) of 1.20. The shape factor SF1 is 141, which indicates a rugged potato-like shape. The amount of a toluene insoluble component of the toner is 11.5% by weight.

An external addition toner is obtained by using the resulting toner (toner particles) in the same manner as in Example 1 to prepare a developer. The fixing property of the toner is then evaluated in the same manner as in Example 1, and it is found that the oilless fixing property with a PFA tube fixing roll is insufficient, and sufficient fixing cannot be obtained until 170° C. While the releasing property is sufficient, the surface glossiness of the image at a fixing temperature 180° C. is as considerably low as 20%, and the image exhibits low chroma.

While occurrence of hot offset is not observed at a fixing temperature of 220° C., the image is poor in developing property and transfer property and has insufficient distinction.

The fixing property of the toner is similarly evaluated by using an OHP sheet (for monochrome printing, produced by Fuji Xerox Co., Ltd.), and it is found that an image on the OHP sheet is a considerably turbid transparent image.

The production conditions and the evaluation results of Examples 1 to 4 and Comparative Examples 1 and 2 are shown in Table 1.

TABLE 1

| | Example | | | | Comparative Example | |
|---|---|---|---|---|---|---|
| | 1 | 2 | 3 | 4 | 1 | 2 |
| Kind and amount (part by weight) of resin dispersion | (1)/268 | (2)/268 | (2)/268 | (1)/268 | (2)/268 | (1)/268 |
| Kind and amount (part by weight) of colorant dispersion | (1)/40 | (2)/40 | (3)/40 | (1)/40 | (3)/40 | (1)/40 |
| Kind and amount (part by weight) of releasing agent dispersion | (1)/40 | (1)/40 | (1)/40 | (1)/40 | (1)/40 | (1)/40 |
| Amount of aluminum chloride (part by | 0.15 | 0.15 | 0.12 | 0.25 | 0.10 | 0.25 |
| Lowest pH upon heating to 95° C. in fusion and uniting step | 5.5 | 5.0 | 5.0 | 5.5 | 4.0 | 7.0 |
| $D_{50\,V}$ ($\mu$m) | 5.60 | 5.40 | 5.32 | 5.92 | 5.45 | 5.62 |
| SF1 | 128 | 124 | 119 | 135 | 115 | 141 |
| Surface property index (equation (A)) | 1.55 | 1.32 | 1.20 | 1.95 | 1.15 | 2.2 |
| Toluene insoluble component (%) | 5.4 | 2.8 | 0.8 | 9.5 | 0.4 | 11.5 |
| Lowest fixing temperature (° C.) | 140 | 135 | 135 | 145 | 130 | 170 |
| Hot offset temperature (° C.) | >220 | >220 | 220 | >220 | 180 | >220 |
| Glossiness (%) | 65 | 76 | 85 | 48 | cannot be evaluated | 20 |
| OHP transparency | Good | good | good | good | cannot be evaluated | poor |

It is understood from the results shown in Table 1 that when the toners of Examples 1 to 4 are used, such fixing properties are excellent as the fixing property of a fixed image on a fixing sheet, the releasing property of the fixing sheet, the hot offset resistance, the bending resistance of the fixed image, the surface glossiness of the fixed image and the transparency of an OHP sheet, and an image excellent in developing and transferring properties and image quality can be formed.

According to the invention, a toner for developing an electrostatic image that has a wide fixable temperature range, is excellent in development and transfer performance and excellent in releasing performance, realizes both glossiness and transparency, and is capable of providing an image (particularly a color image) of a wide color reproduction range having high quality and high durability can be provided, and a developer for an electrostatic image using the same and a process for forming an image using the same are also provided.

The entire disclosure of Japanese Patent Application No. 2002-2289 filed on Jan. 9, 2002 including specification, claims and abstract is incorporated herein by reference in its entirety.

What is claimed is:

1. A toner for developing an electrostatic image, the toner comprising a binder resin having polar groups, a colorant and an inorganic metallic salt having divalent or more electric charge, wherein an amount of a toluene insoluble component from which the colorant, a releasing agent and inorganic and organic insoluble particles are excluded is from 0.5 to 10% by weight.

2. The toner for developing an electrostatic image as claimed in claim 1, wherein the toner has a shape factor SF1 represented by the following equation (1) of 140 or less:

$$SF1=R^2/A\times\pi/4\times100 \quad (1)$$

wherein R represents a maximum length of the toner, and A represents a projected area of the toner.

3. The toner for developing an electrostatic image as claimed in claim 1, wherein the toner has a surface property index represented by the following equation (A) of 2.0 or less:

$$\text{surface property index}=(\text{measured specific surface area})/(\text{calculated specific surface area}) \quad (A)$$

wherein the calculated specific surface area herein is obtained by the following equation:

$$\text{calculated specific surface area}=6\Sigma(n\times R^2)/(\rho\times\Sigma(n\times R^3))$$

wherein n represents the number of particles of the toner present in a channel of Coulter counter, R represents a channel particle diameter ($\mu$m) in the Coulter counter, and ρ represents the toner density (g/cm$^3$).

4. The toner for developing an electrostatic image as claimed in claim 1, wherein the toner contains a releasing agent in an amount of 10% by weight or more based on the total weight of the solid content constituting the toner.

5. The toner for developing an electrostatic image as claimed in claim 1, wherein the toner is obtained by a wet process comprising the steps of: aggregating particles in a dispersion containing resin particles, colorant particles and an inorganic metallic salt, to obtain aggregated particles; and heating the aggregated particles to coalesce them.

6. The toner for developing an electrostatic image as claimed in claim 1, wherein a metallic element constituting the inorganic metallic salt is selected from the 2A, 3A, 4A, 5A, 6A, 7A, 8, 1B, 2B and 3B groups of the long form periodic table.

7. The toner for developing an electrostatic image as claimed in claim 1, wherein the amount of a toluene insoluble component is from 2 to 6% by weight.

8. The toner for developing an electrostatic image as claimed in claim 1, wherein the toner has a weight average molecular weight in a range of from 15,000 to 55,000.

9. A developer for an electrostatic image comprising a toner and a carrier, the toner comprising a binder resin having polar groups, a colorant and an inorganic metallic salt having divalent or more electric charge, wherein an amount of a toluene insoluble component from which the colorant, a releasing agent and inorganic and organic insoluble particles are excluded is from 0.5 to 10% by weight.

10. The developer for an electrostatic image as claimed in claim 9, wherein the carrier has a resin coating layer.

11. The developer for an electrostatic image as claimed in claim 9, wherein the toner has a shape factor SF1 represented by the following equation (1) of 140 or less:

$$SF1=R^2/A\times\pi/4\times100 \quad (1)$$

wherein R represents a maximum length of the toner, and A represents a projected area of the toner.

12. The developer for an electrostatic image as claimed in claim 9, wherein the toner contains a releasing agent in an amount of 10% by weight or more based on the total weight of the solid content constituting the toner.

13. The developer for an electrostatic image as claimed in claim 9, wherein a metallic element constituting the inorganic metallic salt of the toner is selected from the 2A, 3A, 4A, 5A, 6A, 7A, 8, 1B, 2B and 3B groups of the long form periodic table.

14. A process for producing a toner for developing an electrostatic image, the process comprising a wet process comprising steps of: aggregating particles in a dispersion containing resin particles having polar groups, colorant particles and an inorganic metallic salt having divalent or more electric charge, to obtain aggregated particles; and heating the aggregated particles to coalesce them, wherein an amount of a toluene insoluble component contained in the toner, from which the colorant, a releasing agent and inorganic and organic insoluble particles are excluded, is 0.5 to 10% by weight.

15. The process for producing a toner for developing an electrostatic image as claimed in claim 14, wherein the resin particles have a center diameter (median diameter) of 1 $\mu$m or less.

16. A process for forming an image comprising the steps of: forming an electrostatic latent image on a electrostatic image holding member; developing the electrostatic latent image on a developer holding member with a developer for electrostatic image containing a toner to form a toner image; transferring the toner image to a transfer material; and fixing the toner image with heat, the toner being a toner according to claim 1.

17. The process for forming an image as claimed in claim 16, wherein the toner has a shape factor SF1 represented by the following equation (1) of 140 or less:

$$SF1=R^2/A\times\pi/4\times100 \quad (1)$$

wherein R represents a maximum length of the toner, and A represents a projected area of the toner.

18. The process for forming an image as claimed in claim 16, wherein the toner has a surface property index represented by the following equation (A) of 2.0 or less:

$$\text{surface property index}=(\text{measured specific surface area})/(\text{calculated specific surface area}) \quad (A)$$

wherein the calculated specific surface area herein is obtained by the following equation:

$$\text{calculated specific surface area}=6\Sigma(n\times R^2)/(\rho=\Sigma(n=R^3))$$

wherein n represents the number of particles of the toner present in a channel of Coulter counter, R represents a channel particle diameter ($\mu$m) in the Coulter counter, and $\rho$ represents the toner density (g/cm$^3$).

19. The process for forming an image as claimed in claim 16, wherein the toner contains a releasing agent in an amount of 10% by weight or more based on the total weight of the solid content constituting the toner.

* * * * *